US009714658B2

(12) United States Patent
Miyata et al.

(10) Patent No.: US 9,714,658 B2
(45) Date of Patent: Jul. 25, 2017

(54) CENTRIFUGAL COMPRESSOR

(75) Inventors: Hiroyuki Miyata, Hiroshima (JP); Naoto Yonemura, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 507 days.

(21) Appl. No.: 14/234,447

(22) PCT Filed: Jan. 30, 2012

(86) PCT No.: PCT/JP2012/051963

§ 371 (c)(1),
(2), (4) Date: Jan. 23, 2014

(87) PCT Pub. No.: WO2013/021664

PCT Pub. Date: Feb. 14, 2013

(65) Prior Publication Data

US 2014/0161588 A1 Jun. 12, 2014

(30) Foreign Application Priority Data

Aug. 5, 2011 (JP) ..... 2011-172237

(51) Int. Cl.
*F01D 15/12* (2006.01)
*F04D 17/12* (2006.01)
(Continued)

(52) U.S. Cl.
CPC ..... *F04D 17/12* (2013.01); *F04D 25/163* (2013.01); *F04D 27/002* (2013.01);
(Continued)

(58) Field of Classification Search
CPC ..... F04D 17/12; F04D 29/054; F04D 25/163; F04D 27/002; F04D 27/0246
(Continued)

(56) References Cited

U.S. PATENT DOCUMENTS 2,079,691 A * 5/1937 Joyce ..... F16H 61/0262 475/258
3,191,630 A 6/1965 Demyan
(Continued)

FOREIGN PATENT DOCUMENTS

CN 101265917 9/2008
DE 40 03 482 11/1991
(Continued)

OTHER PUBLICATIONS

Third Party Observation issued Oct. 23, 2015 in corresponding European Patent Application No. 12821841.9 with English translation.

(Continued)

*Primary Examiner* — Jason Shanske
*Assistant Examiner* — Kelsey Stanek
(74) *Attorney, Agent, or Firm* — Wenderoth, Lind & Ponack, L.L.P.

(57) ABSTRACT

A centrifugal compressor, the capacity of which can be increased with keeping the diameter of the impeller at minimum, is provided. The centrifugal compressor includes: a drive gear (11); a drive shaft (3) protruding from one side of the drive gear (11) in a central axis direction of the drive gear (11); a no. 1 driven pinion gear (12) configured for rotation of the drive gear (11) to be transmitted thereto; a no. 1 driven pinion shaft (5) protruding from both sides of the no. 1 driven pinion gear (12) in a central axis direction of the no. 1 driven pinion gear (12); and a couple of first stage compressor sections (7*a*, 7*b*), each of which is provided in each end of the no. 1 driven pinion shaft (5) and is configured to compress fluid by rotation of the no. 1 driven pinion shaft (5).

8 Claims, 5 Drawing Sheets

(51) Int. Cl.

| | |
|---|---|
| ***F04D 25/16*** | (2006.01) |
| ***F04D 27/00*** | (2006.01) |
| ***F04D 29/054*** | (2006.01) |
| ***F04D 27/02*** | (2006.01) |
| ***F25J 3/04*** | (2006.01) |

(52) U.S. Cl.
CPC ..... *F04D 27/0246* (2013.01); *F04D 29/054* (2013.01); *F25J 3/04018* (2013.01); *F25J 3/04957* (2013.01); *F25J 2230/20* (2013.01); *F25J 2230/24* (2013.01); *F25J 2230/40* (2013.01)

(58) Field of Classification Search
USPC ..... 415/122.1, 17, 124.1
See application file for complete search history.

(56) References Cited

U.S. PATENT DOCUMENTS

| | | | | |
|---|---|---|---|---|
| 3,715,887 | A * | 2/1973 | Weatherly et al. | C01B 21/26 422/510 |
| 4,829,850 | A * | 5/1989 | Soloy | B64D 7/00 248/554 |
| 5,154,571 | A | 10/1992 | Prümper | |
| 5,382,132 | A | 1/1995 | Mendel | |
| 6,393,865 | B1 * | 5/2002 | Coakley | F25J 3/04018 62/643 |
| 6,484,533 | B1 * | 11/2002 | Allam | F25J 1/0012 62/643 |
| 2006/0156728 | A1 | 7/2006 | Rodehau et al. | |
| 2010/0098534 | A1 * | 4/2010 | Small | F04D 17/12 415/204 |

FOREIGN PATENT DOCUMENTS

| | | | |
|---|---|---|---|
| DE | 4034928 | | 5/1992 |
| DE | 42 34 739 | | 11/1993 |
| DE | 42 41 141 | | 6/1994 |
| DE | 44 36 710 | | 4/1996 |
| DE | 102005014264 | | 9/2006 |
| DE | 10 2009 038 786 | | 5/2011 |
| EP | 0 440 902 | | 6/1994 |
| EP | 1 027 913 | | 8/2000 |
| EP | 1 041 289 | | 10/2000 |
| EP | 1 067 291 | | 1/2001 |
| EP | 1 205 721 | | 5/2002 |
| EP | 1 302 668 | | 4/2003 |
| EP | 2 128 448 | | 12/2009 |
| EP | 1 691 081 | | 3/2010 |
| EP | 2159394 | | 3/2010 |
| FR | 984248 | | 7/1951 |
| GB | 967091 | | 8/1964 |
| JP | 48-75952 | | 10/1973 |
| JP | 50-040901 | | 4/1975 |
| JP | 56-140073 | | 10/1981 |
| JP | 61-194800 | | 12/1986 |
| JP | 5-18394 | | 1/1993 |
| JP | 6-193585 | | 7/1994 |
| JP | 08-159094 | | 6/1996 |
| JP | 2000-28169 | | 1/2000 |
| JP | 2000028169 | A * | 1/2000 |
| JP | 2003-322097 | | 11/2003 |
| JP | 2003322097 | A * | 11/2003 |
| JP | 2006-200531 | | 8/2006 |
| JP | 2007-332826 | | 12/2007 |
| JP | 2009-91935 | | 4/2009 |
| JP | 2009-162165 | | 7/2009 |
| JP | 2009-174692 | | 8/2009 |
| JP | 2010-133678 | | 6/2010 |
| WO | 01/04477 | | 1/2001 |
| WO | 2012/104153 | | 8/2012 |

OTHER PUBLICATIONS

Third Party Observation issued Nov. 16, 2015 in corresponding European Patent Application No. 12821841.9 with English translation.

Third Party Observation issued Nov. 25, 2015 in corresponding European Patent Application No. 12821841.9 with English translation.

Third Party Observation issued Jul. 26, 2013 in corresponding European Patent Application No. 12821841.9 with English translation.

Chinese Office Action (OA) and Search Report (SR) issued Jun. 5, 2015 in Chinese Patent Application No. 201280029854.1, together with partial translation of the Search Report.

Extended European Search Report issued Sep. 22, 2015 in European Patent Application No. 12821841.9.

International Search Report issued Apr. 24, 2012 in International (PCT) Application No. PCT/JP2012/051963 with English translation.

Written Opinion of the International Searching Authority issued Apr. 24, 2012 in International (PCT) Application No. PCT/JP2012/051963 with English translation.

"VK/HVK Integrally Geared Centrifugal Compressors", Mannesmann Demag Delaval Catalog, Feb. 1995.

* cited by examiner

CENTRIFUGAL COMPRESSOR

TECHNICAL FIELD

The present invention relates to a centrifugal compressor with an speed increasing gear system.

Priority is claimed on Japanese Patent Application No. 2011-172237, filed Aug. 5, 2011, the content of which is incorporated herein by reference.

BACKGROUND ART

As generally recognized, the centrifugal compressor compresses gas utilizing the centrifugal force generated when the gas passes through rotating impeller in the radial direction. The centrifugal compressor is used in plants for petrochemistry, natural gas, or air separation.

As the centrifugal compressor, the one shaft multistage centrifugal compressor and the integrally geared centrifugal compressor (hereinafter, referred as "a geared compressor") are known. In the one shaft multistage centrifugal compressor, the impeller compressing the gas is attached to a single shaft. In the geared compressor, the impeller is attached to ends of pinion shafts. As a variation of the geared compressor, the geared compressor, in which the working fluid is compressed by multiple compressor sections with impellers provided to the ends of multiple driven pinion shafts, is known (see Patent Literature 1, for example).

FIG. 5 is a schematic cross-sectional plain view of a conventional geared compressor 101. As shown in FIG. 5, the conventional geared compressor 101 includes: the driving source 19; the drive shaft 2 rotatably driven by the driving source 19; the speed increasing gear system 110 to which the driving force of the drive shaft 2 is transmitted; the no. 1 driven pinion shaft 5 protruding to both sides of the no. 1 driven pinion gear 112 constituting the speed increasing gear system 110; and the no. 2 driven pinion shaft 6 protruding to both sides of the no. 2 driven pinion gear 113 constituting the speed increasing gear system 110. In the conventional geared compressor 101, each of the first stage compressor section 107 and the second stage compressor section 108, is provided to each end of the no. 1 driven pinion shaft 5. Also, the third stage compressor section 109 and the counter weight 116 are provided to one end and the other end of the no. 2 driven pinion shaft, respectively.

The speed increasing gear system 110 includes: the drive gear 111 provided to the drive shaft 2; the no. 1 driven pinion gear 112 provided to the no. 1 driven pinion shaft 5; and the no. 2 driven pinion gear 113 provided to the no. 2 driven pinion shaft 6. Having the gears configured as described above, rotation of the drive shaft 2 is accelerated and transmitted to the driven pinion shafts 5, 6.

The first stage compressor section 107 and the second stage compressor section 108 are connected each other through the first stage heat exchanger 27. The second stage compressor section 108 and the third stage compressor section 109 are connected each other through the second stage heat exchanger 28.

Configured as described above, the work fluid introduced to the geared compressor 101 is compressed by the three-staged compressor sections 107, 108, 109. In addition, compression efficiency is improved by intermediate cooling of the work fluid by the heat exchangers 27, 28 provided between the compressor sections.

RELATED ART DOCUMENTS

Patent Literature

Patent Literature 1: Japanese Unexamined Patent Application, First Publication No. 2007-332826

DISCLOSURE OF INVENTION

Problems to be Solved by the Invention

When capacity of the geared compressor is intended to be increased, it is a general approach to increase the size of the impeller. However, practically there is a limitation in increasing the size of the impeller. Thus, other options such as using multiple geared compressors, an axial compressor, and the like have to be taken.

The present invention is made under the circumstance described above. The purpose of the present invention is to provide a centrifugal compressor with an speed increasing gear system, the capacity of which can be increased with keeping the diameter of the impeller at minimum.

Means for Solving the Problems

In order to achieve the purpose of the present invention, means to solve the problems described below are provided.

The first aspect of the present invention is a centrifugal compressor including: a drive gear; a drive shaft protruding from one side of the drive gear in a central axis direction of the drive gear; a no. 1 driven pinion gear configured for rotation of the drive gear to be transmitted thereto; a no. 1 driven pinion shaft protruding from both sides of the no. 1 driven pinion gear in a central axis direction of the no. 1 driven pinion gear; and a couple of first stage compressor sections, each of which is provided in each end of the no. 1 driven pinion shaft and is configured to compress fluid by rotation of the no. 1 driven pinion shaft.

By having the configuration described above, the capacity of the centrifugal compressor can be increased with keeping the diameter of the impeller at minimum, since it has two first stage compressor sections and they are positioned at both ends of the no. 1 driven pinion shaft.

In the first aspect of the present invention, the centrifugal compressor may further include a no. 1 idle gear provided between the no. 1 driven pinion gear and the drive gear.

By having the configuration described above, the size of the first stage compressor can be further increased without interfering the drive shaft by providing the no. 1 idle gear and retaining a long shaft distance between the no. 1 driven pinion shaft and the drive shaft. Thus, the capacity of the centrifugal compressor can be further increased, while the size of the drive gear and the no. 1 driven pinion gear can be kept at minimum.

The above-described centrifugal compressor may further include: a no. 2 driven pinion gear configured for rotation of the drive gear to be transmitted thereto; a no. 2 driven pinion shaft protruding from the no. 2 driven pinion gear in a central axis direction of the no. 2 driven pinion gear; a second stage compressor section provided to the no. 2 driven pinion shaft; and a no. 2 idle gear provided between the no. 2 driven pinion gear and the drive gear.

In the configuration describe above, in which the compression ratio is increased by having the compressor section with multiple stages, the first stage compressor is constituted from two first stage compressor sections and the intermediate gear is provided between the driven gear and the drive gear. Thus, the compression ratio is increased without interference with the side of the drive shaft and the first stage compressor sections by providing the intermediate gear between the driven gear and the drive gear. At the same time, the capacity of the centrifugal compressor is effectively increased.

In the above-described centrifugal compressor, rotation axes of the no. 1 idle gear and the no. 2 idle gear may be displace an upper or a lower side with respect to a rotation axis of the drive gear in a vertical direction.

By having the configuration described above, the status of the drive shaft in operation can be stabilized, since more load can be placed on the bearing supporting the drive shaft compared to the situation where the rotation centers of the no. 1 and the no. 2 idle gears are positioned in the same height position as that of the drive gear.

The above-described centrifugal compressor may further include: a third stage compressor section provided to the no. 2 driven pinion shaft in an opposite side to the second stage compressor section in the central axis direction of the no. 2 driven pinion gear; a no. 3 driven pinion gear configured for rotation of the drive gear to be transmitted thereto; a no. 3 driven pinion shaft protruding from the no. 3 driven pinion gear in a central axis direction of the no. 3 driven pinion gear; a fourth stage compressor section provided to the no. 3 driven pinion shaft; and a no. 3 idle gear provided between the no. 3 driven pinion gear and the drive gear, wherein rotation axes of two of the no. 1, no. 2, and no. 3 idle gears are displace an upper or a lower side with respect to the rotation axis of the drive gear in the vertical direction, and a rotation axis of the remaining intermediate gear is displaced other side with respect to the rotation axis of the drive gear in the vertical direction.

By having the configuration described above, in a case where the compression ratio is increased by constituting the centrifugal compressor with the compressor section of four or more stages, the status of the drive shaft in operation can be stabilized, since more load can be placed on the bearing supporting the drive shaft. Also, by distributing each of the rotation centers of two intermediate gears and the rotation center of one remaining intermediate gear to each of the upper and lower sides, interference between each of intermediate gears can be prevented.

The above-described centrifugal compressor may further include: a heat exchanger provided to a pipe connecting the pair of the first stage compressor sections and the second stage compressor section, the heat exchanger exchanging heat of the fluid discharged from the pair of the first stage compressor sections, wherein the heat exchanger comprises: two inlets, each of which is connected to each of the pair of the first stage compressor sections; and an outlet connected to the second stage compressor section.

Furthermore, the above-described centrifugal compressor may further include: an inlet guide vane that is provided to each of the pair of the first stage compressor sections at an upstream side thereof and configured to control an amount of the fluid introduced to the pair of the first stage compressor sections; a first pressure sensor and a flowmeter provided to each of the pair of the first stage compressor sections at an upstream side thereof; a second pressure sensor provided to each of the pair of the first stage compressor sections at a downstream side thereof; and a control unit configured to control the inlet guide vane based on measurements detected by the first pressure sensor, the flow meter, and the second pressure sensor.

By having the configurations described above, it can be controlled depending on performance of each of two impellers constituting the first stage compressor sections, in a case where performance difference between the impellers of two first stage compressor sections was formed because of malfunctioning, a dimension error in production, performance change due to continuous usage for a long period of time, or the like.

Effects of the Invention

According to the present invention, the capacity of the centrifugal compressor can be increased with keeping the diameter of the impeller at minimum, since it has two first stage compressor sections and they are positioned at both ends of the no. 1 driven pinion shaft.

BEST MODE FOR CARRYING OUT THE INVENTION

First Embodiment

The first embodiment of the present invention is explained below in reference to drawings.

Figure 1:
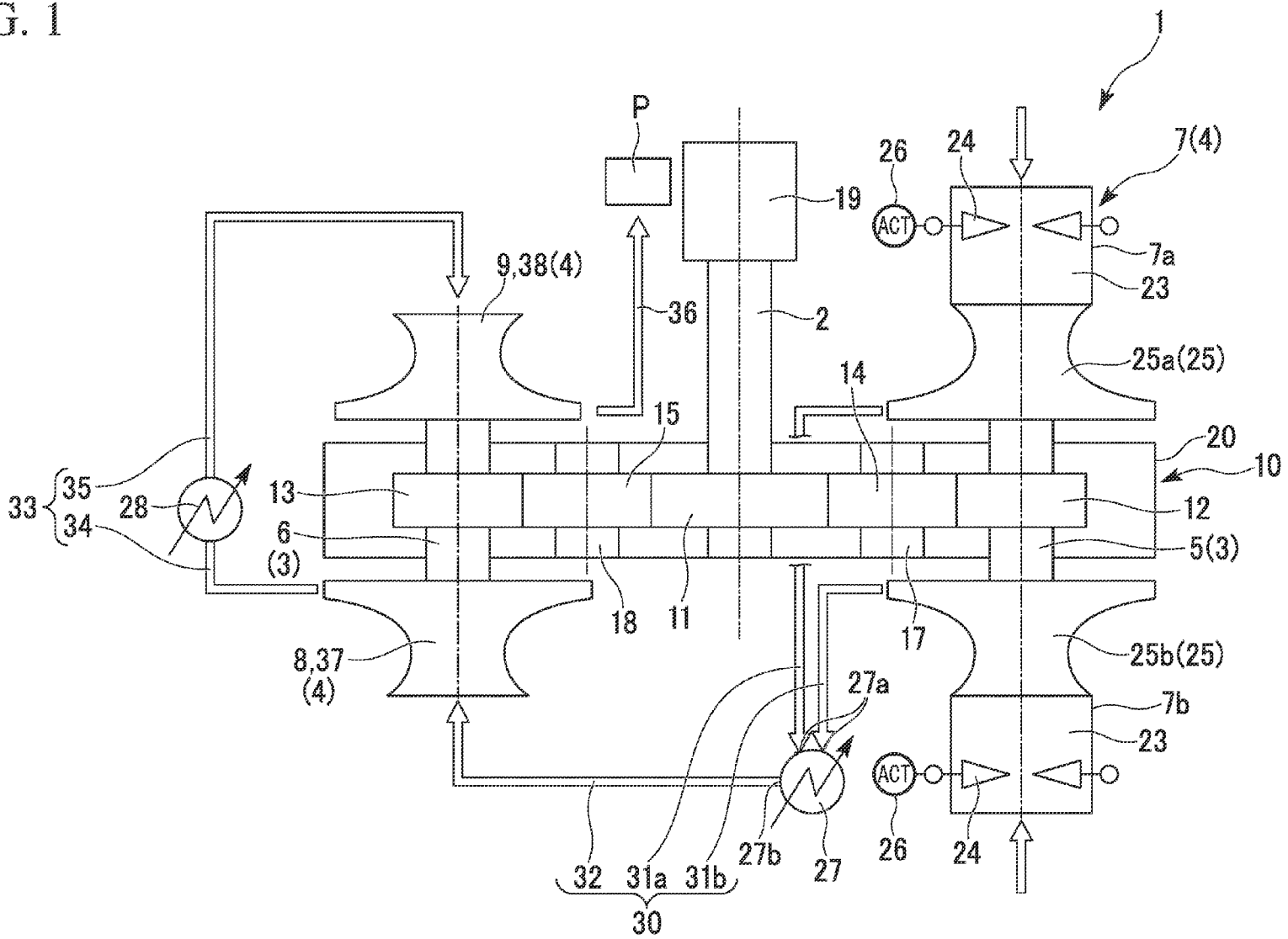
FIG. 1 is a schematic plan view of the centrifugal compressor related to the first embodiment of the present invention.

As shown in FIG. 1, the centrifugal compressor 1 related to the embodiment of the present invention includes: the driving source 19 generating the driving force; the drive shaft 2 that rotatably drives by the driving source 19; the speed increasing gear system 10 that changes speeds of the rotating movement of the drive shaft 2 and transmits the movement; the driven pinion shaft 3 to which the driving force transmitted by the speed increasing gear system 10 is output; and the compressor section 4 driven by the driving force transmitted by the driven pinion shaft 3.

The speed increasing gear system 10 includes the drive gear 11 on which the drive shaft 2 protrudes from one side of the drive gear 11 in a central axis direction of the drive gear 11. The speed increasing gear system 10 also includes the no. 1 driven pinion gear 12 and the no. 2 driven pinion gear 3 to which rotation of the drive gear 11 is accelerated and transmitted separately. The speed increasing gear system 10 also includes the no. 1 idle gear 14, which is provided and engaged between the no. 1 driven pinion gear 12 and the drive gear 11. It also includes the no. 2 idle gear 15, which is provided and engaged between the no. 2 driven pinion gear 13 and the drive gear 11.

The driven pinion shaft 3 includes: the no. 1 driven pinion shaft 5 protruding from both sides of the no. 1 driven pinion gear 12 in a central axis direction of the no. 1 driven pinion gear 12 and the no. 2 driven pinion shaft 6 protruding from the both sides of the no. 2 driven pinion gear 13 in a central axis direction of the no. 2 driven pinion gear 13.

As the compressor section 4, the centrifugal compressor 1 includes two first stage compressor sections 7*a*, 7*b*, each of which is provided in each side of the central axis of the no. 1 driven pinion shaft 5. In addition, the centrifugal compressor 1 includes the second stage compressor section 8. The second stage compressor section 8 is provided to the other end part of the no. 2 driven pinion shaft 6 on the opposite side of the central axis of the no. 2 driven pinion shaft 6, which is opposite to the side provided with the driving source 19 (the one end part). The central compressor 1 also includes the third stage compressor section 9. The third stage compressor 9 is provided to the one end part of the no. 2 driven pinion shaft 6, which is the side that the driving source 19 is provided to.

The gears constituting the speed increasing gear system 10 are encased in the casing 20, and each shaft is supported by a bearing which is not indicated in the drawing of the casing 20.

Each of the first stage compressor sections 7*a*, 7*b*, the second stage compressor section 8, and the third stage compressor section has the impellers 25, 37, 38, respectively. They compress the work fluid by using the impellers 25, 37, 38. The impellers 25, 37, 38 discharge the work fluid introduced from the inlet to the radially outer circumferential side through the flow passage formed insides.

Among the three types of impellers 25, 37, and 38, the outer diameter of the impeller 37, which is used for the second stage compressor section 8, is set to be substantially the same dimension as that of the impeller 25 of the first stage compressor sections 7*a*, 7*b*, since the work fluid exhausted from the two impeller 25*a*, 25*b* constituting the first stage compressor sections 7*a*, 7*b* is introduced to the second stage compressor section 8.

The no. 1 idle gear 14 and the no. 2 idle gear 15 are so called the idle gears. The no. 1 idle gear 14 is rotatably supported by the no. 1 idle shaft 17. The no. 2 idle gear 15 is rotatably supported by the no. 2 idle shaft 18.

By having gears configured as described above, the drive gear 11 is rotated by rotation of the drive shaft 2. Then, the no. 1 idle gear 14 and the no. 2 idle gear 15 are rotated in response to the rotation of the drive gear 11. Then, the no. 1 driven pinion gear 12 and the no. 2 driven pinion gear 13 are rotated in response to the rotation of the no. 1 idle gear 14 and the no. 2 idle gear 15. Then, the no. 1 driven pinion shaft 5 is rotated in response to the rotation of the no. 1 driven pinion gear 12, and the no. 2 driven pinion shaft 6 is rotated in response to the rotation of the no. 2 driven pinion gear 13.

In short, the no. 1 driven pinion shaft 5 and the no. 2 driven pinion shaft 6 are rotated by the drive shaft 2 being driven.

Figure 2A:
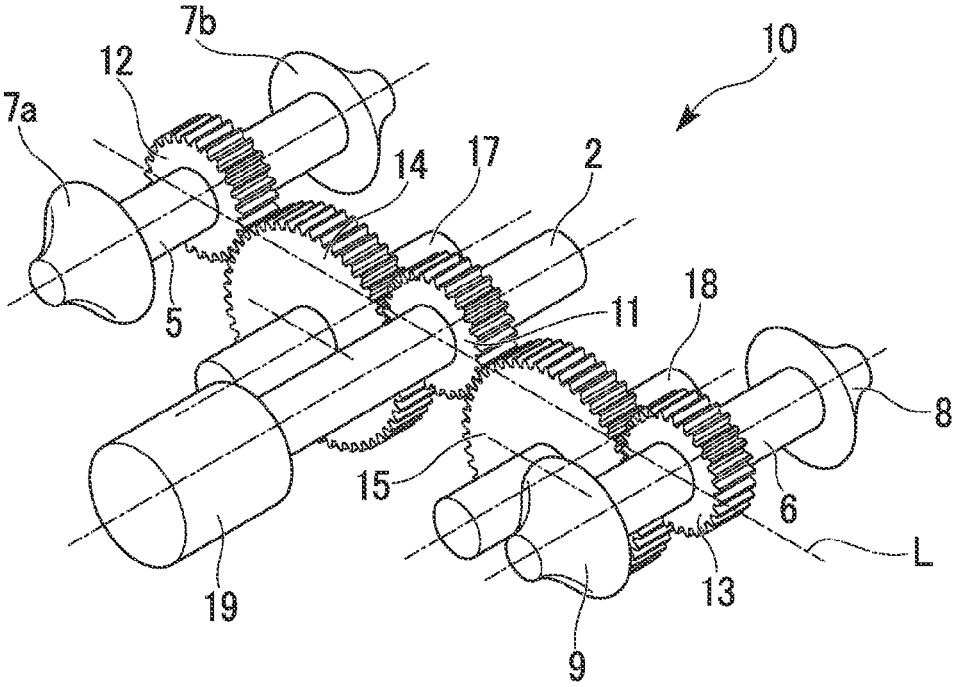
FIG. 2A is a schematic perspective view showing arrangement of gears constituting the speed increasing gear system of the centrifugal compressor related to the first embodiment of the present invention.

FIG. 2A is a schematic perspective view showing arrangement of gears constituting the speed increasing gear system 10. As shown in FIG. 2A, the central height level of the drive gear 11, which is the height from a predetermined standard surface, is set to the substantially the same height level as those of the no. 1 driven pinion gear 12 and the no. 2 driven pinion gear 13. That is, centers of the drive gear 11, the no. 1 driven pinion gear 12, and the no. 2 driven pinion gear 13 are positioned on the center line L.

Contrary to that, the centers of the no. 1 idle gear 14 and the no. 2 idle gear 15 are positioned so as to be offset downward relative to the center line L. That is, the intermediate shafts 17, 18 supporting the intermediate gears 14, 15 are not positioned on the same plane on which the drive shaft 2 is positioned.

Next, the configuration for connecting each compressor section is explained.

Two first stage compressor sections 7*a*, 7*b* are connected to the second stage compressor section 8 through the first stage pipe 30. The first stage pipe 30 is constituted from two discharge pipes 31*a*, 31*b* for the first stage compressor sections and the suction pipe 32 for the second stage compressor section. Between the discharge pipes 31*a*, 31*b* for the first stage compressor sections and the suction pipe 32 for the second stage compressor section, the first stage heat exchanger 27 is provided.

The first stage heat exchanger 27 includes: two inlet nozzles 27*a*; and an outlet nozzle 27*b*. To each of two inlet nozzle 27*a*, each of the discharge pipe for the first stage compressor sections 31*a*, 31*b* is connected. Also, the suction pipe 32 for the second stage compressor section is connected to the outlet nozzle 27*b*. Thus, the first stage heat exchanger 27 is capable of: cooling the work fluid from two separate lines discharged from the two first stage compressor sections 7*a*, 7*b*; and merging the work fluid from two separate lines to have the work fluid in a single line.

The second stage compressor section 8 is connected to the third stage compressor section 9 through the second stage pipe 33. The second stage pipe 33 is constituted from the discharge pipe 34 for the second stage compressor section and the suction pipe 35 for the third stage compressor section. Between the discharge pipe 34 for the second stage compressor section and the suction pipe 35 for the third stage compressor section, the second stage heat exchanger 28 is provided.

The first stage heat exchanger 27 and the second stage heat exchanger 28 are coolers for intermediate cooling of the work fluid. By cooling the work fluid intermediately during compression process, the power needed for driving the centrifugal compressor 1 is reduced.

Next, configurations of the first stage compressor sections 7*a*, 7*b*, the second stage compressor section 8, and the third stage compressor section 9 are explained below.

The first stage compressor sections 7*a*, 7*b* are the compressor sections that the work fluid is introduced in the beginning in the centrifugal compressor 1 of the present embodiment. Two first stage compressor sections 7*a*, 7*b* are configured identically. Each of them includes: the gas introducing part 23 supplying the fluid to be compressed; the inlet guide vane (IGV) 24 guiding the fluid supplied from the gas introducing part 23, the angle of which is variable; and the impeller 25 fixed on the no. 1 driven pinion shaft 5. Thus, gas is introduced from two gas introducing parts 23 in the centrifugal compressor 1 of the present embodiment. The gas outlets of the two impellers 25 constituting the two first stage compressor sections 7*a*, 7*b* are connected to the discharge pipe 31*a*, 31*b* for the first stage compressor section, respectively.

The inlet guide vane 24 is provided to the gas introducing part 24. It controls amount of the work fluid flowing in the compressor by adjusting the degree of opening. It rotates about the axis line perpendicular to the axis line of the impeller 25 by the actuator 26.

The second stage compressor section 8 includes the impeller 37 provided to one end of the no. 2 driven pinion shaft 6. The suction pipe 32 for the second stage compressor section constituting the first stage pipe 30 is connected to the gas inlet of the impeller 37. The suction pipe 34 for the second stage compressor section constituting the second stage pipe 33 is connected to the gas outlet of the impeller 37.

The third stage compressor section 9 includes the impeller 38 provided to the other end of the no. 2 driven pinion shaft 6. The suction pipe 35 for the third stage compressor section constituting the second stage pipe 33 is connected to the gas inlet of the impeller 38. The suction pipe 36 for the third stage compressor section is connected to the gas outlet of the impeller 38.

The action of the centrifugal compressor 1 of the present embodiment is explained below.

The work fluid to be compressed is introduced into the two gas inlet 23*a*, 23*b* constituting the first stage compressor sections 7*a*, 7*b* to be compressed at the two first stage compressor sections 7*a*, 7*b*. Next, the work fluid is introduced into the first stage heat exchanger 27, and merged in the first stage heat exchanger 27. After being cooled intermediately there, the work fluid is introduced into the second stage compressor section 8. The work fluid, which is compressed in the second stage compressor section 8 and discharged from the second stage compressor section 8, is intermediately cooled in the second stage heat exchanger 28. Then, it is introduced into the third stage compressor section 9. Then, after being compressed in the third stage compressor section 9, the work fluid is supplied to a predetermined plant P needing the compressed work fluid.

Next, the controlling system of the centrifugal compressor 1 is explained. Particularly, the method of controlling the inlet guide vane 24, which adjusts the suction pressure of the work fluid introduced into the centrifugal compressor 1, is explained.

Figure 3:
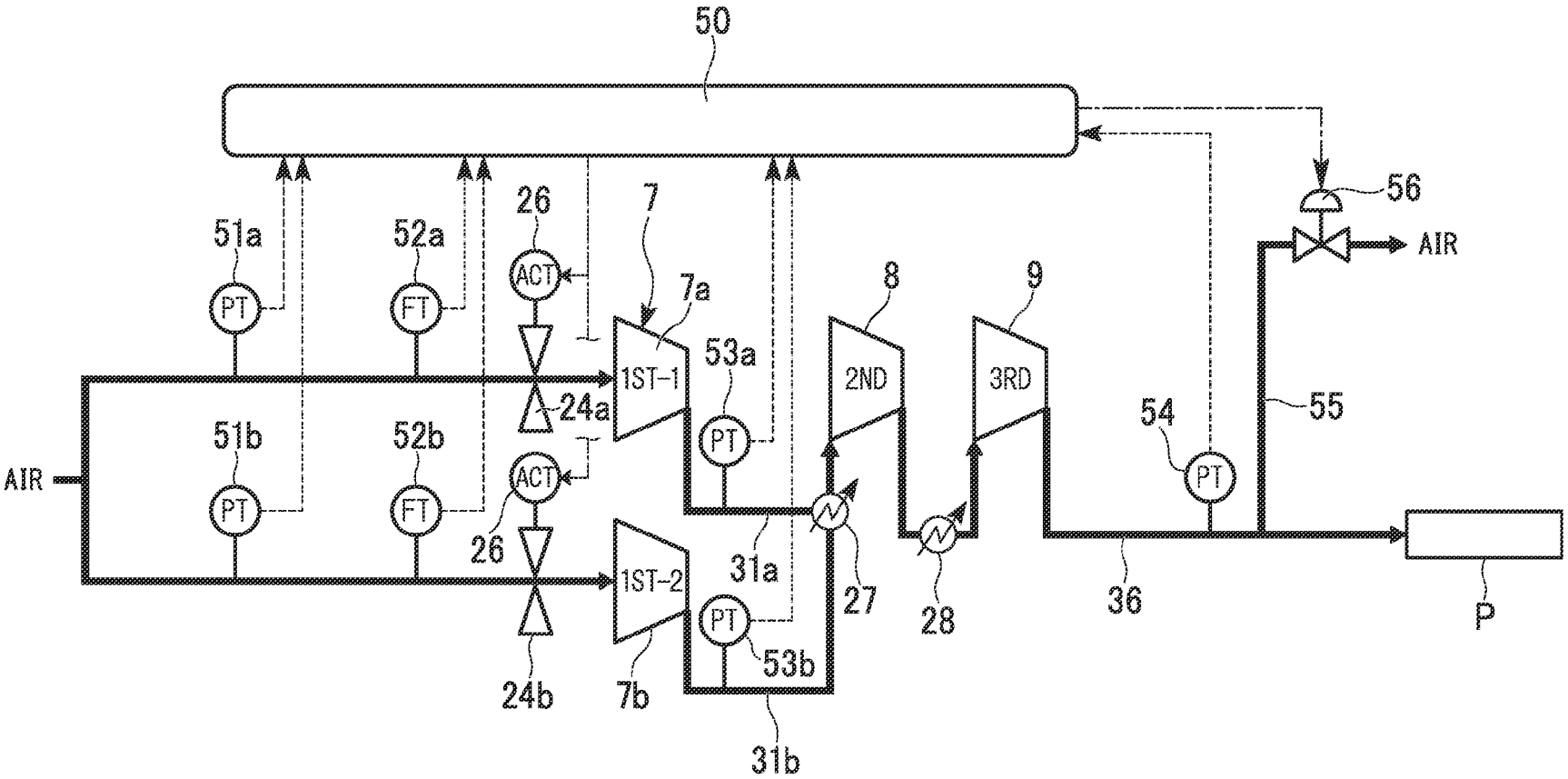
FIG. 3 is a diagram showing the controlling system of the centrifugal compressor related to the first embodiment of the present invention.

As shown in FIG. 3, the controlling system of the centrifugal compressor 1 includes the control system 50. Based on the input of each measurement equipment, the control system 50 controls the actuator 26 driving the inlet guide vane 24 and the gas exhausting valve 56, which is explained later.

At the upstream side of the two first stage compressor sections 7*a*, 7*b*, the first pressure sensors 51*a*, 51*b*, which measure pressure of the work fluid introduced into the first stage compressor sections 7*a*, 7*b*, are provided. In addition, the flowmeters 52*a*, 52*b*, which measure the amount of the work fluid introduced into the first stage compressor sections 7*a*, 7*b*, are provided at the upstream side of the two first stage compressor sections 7*a*, 7*b*. Also, the second pressure sensors 53*a*, 53*b* are provided to the discharge pipe 31*a*, 31*b* for the first stage compressor sections connected to the first stage compressor sections 7*a*, 7*b* at the downstream side of the first stage compressor sections 7*a*, 7*b*.

Also, the third pressure sensor 54 is provided to the discharge pipe 36 for the third stage compressor section locating between the third stage compressor section 9 and the plant P. Also, at the downstream of the third pressure sensor 54 in the discharge pipe 36 for the third stage compressor section, the branched gas exhausting pipe 55 is provided. The gas exhausting valve 56 is provided to the gas exhausting pipe 55.

The first pressure sensors 51*a*, 51*b*, the second pressure sensors 53*a*, 53*b*, the third pressure sensor 43, and the flowmeters 52*a*, 52*b*, are connected to the controlling apparatus 50, and configured to input measured results to the controlling apparatus 50.

Next, the controlling method by the above-described controlling system is explained.

In a normal situation, the inlet guide vanes 24*a*, 24*b* provided in the upstream of the two impellers 25*a*, 25*b* of the first stage compressor sections 7*a*, 7*b*, are controlled by a single controlling method with the controlling apparatus 50. For example, the inlet guide vanes 24*a*, 24*b* are placed in a condition they are opened in a very small extent in the start-up step of the centrifugal compressor 1 to reduce the driving force of the centrifugal compressor 1 in its start-up step.

On other front, the controlling apparatus 50 monitors operation of the impellers 25*a*, 25*b* of the first stage compressor sections 7*a*, 7*b* by measuring the flow amount in the inlets of the first stage compressor sections 7*a*, 7*b* and measuring pressure in inlets and outlets of the two first stage compressor sections 7*a*, 7*b*. Further, the controlling apparatus 50 monitors operation of the second stage compressor section 8 and the third stage compressor section 9 by measuring pressure at the downstream of the third stage compressor section 9, which is the outlet of the centrifugal compressor 1, in addition to the flow amount in the inlet.

In an unusual situation, in which performance difference between the two impellers 25*a*, 25*b* is generated due to a dimension error in production, continuous usage for a long period of time, or the like, the controlling apparatus 50 controls the inlet guide vanes 24*a*, 24*b* differently based on the difference.

Also, the controlling apparatus 50 controls the discharging pressure during a low volume operation in a constant value by regulating the gas exhausting valve 56 appropriately depending on the pressure obtained by the third pressure sensor 54 and the flow amounts obtained by the flowmeters 52*a*, 52*b*. Further, the controlling apparatus 50 performs a surge prevention control.

According to the above-described embodiment, compressing capability can be improved while keeping the diameters of the first stage compressor sections 7*a*, 7*b* at a minimum level, since the two first stage compressor sections 7*a*, 7*b* are arranged in both sides of the no. 1 driven pinion shaft 5. Thus, the capacity of the centrifugal compressor 1 can be increased.

In addition, the first stage compressor sections 7*a*, 7*b* can be further over-sized to increase the capacity of the centrifugal compressor 1, since the distance between the no. 1 driven pinion shaft 5 and the drive shaft 2 is set to be a larger value by providing the no. 1 idle gear 14. On other front, the no. 1 driven pinion gear 12 and the drive gear 11 can be down-sized.

Also, interference between the second stage and third stage compressor sections 8, 9 provided to the both ends of the no. 2 driven pinion shaft 6, and the driven pinion shaft 2 is prevented, since the distance between the no. 1 driven pinion shaft 6 and the drive shaft 2 is set to be a larger value by providing the no. 2 idle gear 15. Also, interference between the second stage and third stage compressor sections 8, 9 and the first stage compressor sections 7*a*, 7*b* is prevented. That is, a high compressing ratio and a high capacity are obtained by providing the intermediate gears, multiplying the first stage compression, and having the compressor section with three-stages.

Figure 2B:
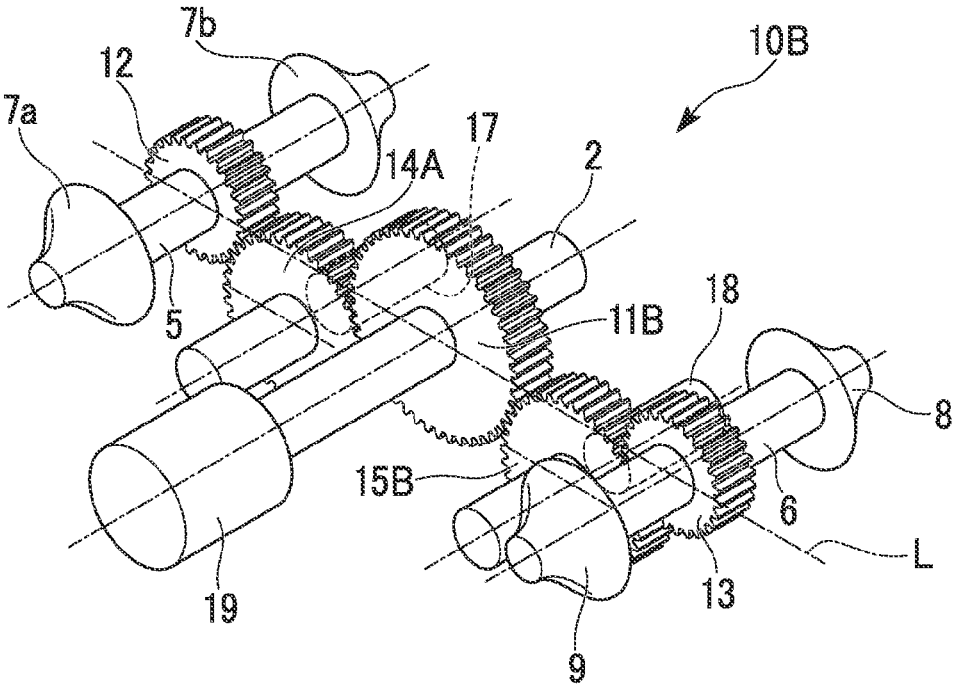
FIG. 2B is a schematic perspective view showing arrangement of gears constituting the speed increasing gear system of the centrifugal compressor related to the first embodiment of the present invention.

Also, as shown in FIG. 2B, when the number of revolutions of the drive shaft 11B (that is, the number of revolution of the driving source 19) is changed, the speed increasing gear system 10B can be re-configured without changing the size of the entire gears by adjusting the number of teeth of the intermediate gears 14B, 15B. That is, the speed increasing gear system 10B can be re-configured without changing the distance between the no. 1 driven pinion shaft 5 and the no. 2 driven pinion shaft 6.

This means matching the revolution number of the drive shaft 2 to the optimum revolution number of the driving source 19 (a steam turbine, a motor, or the like) is possible. Therefore, the optimized system as "a compressor-train" including the centrifugal compressor 1 and the driving source 19 can be obtained.

Also, since centers of the no. 1 and no. 2 idle gears 14, 15 are positioned offset downward relative to the central level of the drive gear 11, more load is placed on the bearing supporting the drive shaft 2 compared to the situation where the rotation centers of the no. 1 and the no. 2 idle gears 14, 15 are positioned in the same height position as that of the drive gear 11. Therefore, the status of the drive shaft 2 in operation can be stabilized.

In other words, the drive shaft 2 positioned in the middle of the speed increasing gear system 10 receives the reactive force from the no. 1 and no. 2 idle gears 14, 15 positioned on either side of the drive shaft 2. The gear reactive force of the no. 1 and no. 2 idle gears 14, 15 act on the opposite direction vertically. Thus is, if the rotation centers of the drive gears 11, and the no. 1 and no. 2 idle gears 14, 15 are aligned in the straight line horizontally, the gear reactive forces from the no. 1 and no. 2 idle gears 14, 15 are cancelled each other. Thus, the load placed on the bearing supporting the drive shaft 2 becomes extremely low. As a result, it becomes unstable as a rotor system.

Contrary to that, by arranging the rotation center of the drive gear 11 displaced relative to the rotation centers of the no. 1 and no. 2 idle gears 14, 15, a certain amount of load is placed on the bearing supporting the drive shaft 2.

In addition, compacting of the dimension of the centrifugal compressor 1 can be obtained since the number of the heat exchanger needed is almost identical relative to the conventional centrifugal compressor even though its capacity is increased.

In addition, the centrifugal compressor 1 related to the present embodiment is configured to monitor the entire operation by the control system 50 by providing the first pressure sensor 51 and the flowmeter 52 at the upstream of the two first stage compressor sections 7*a*, 7*b*, and the second pressure sensor 53 at the downstream of the two first stage compressor sections 7*a*, 7*b*. Because of this, in an unusual situation, in which performance difference between the two impellers 25*a*, 25*b* constituting the two first stage compressor sections 7*a*, 7*b*, is generated due to a dimension error in production, continuous usage for a long period of time, or the like, the two impellers 25*a*, 25*b* are controlled differently based on their performance difference.

Second Embodiment

The second embodiment of the present invention is explained below.

In the centrifugal compressor related to the second embodiment, the fourth stage compressor section 41 and the fifth stage compressor section 42 are further provided to the downstream stage of the third stage compressor section 9*b* that corresponds to the third stage compressor section 9 of the centrifugal compressor 1 related to the first embodiment.

Figure 4:
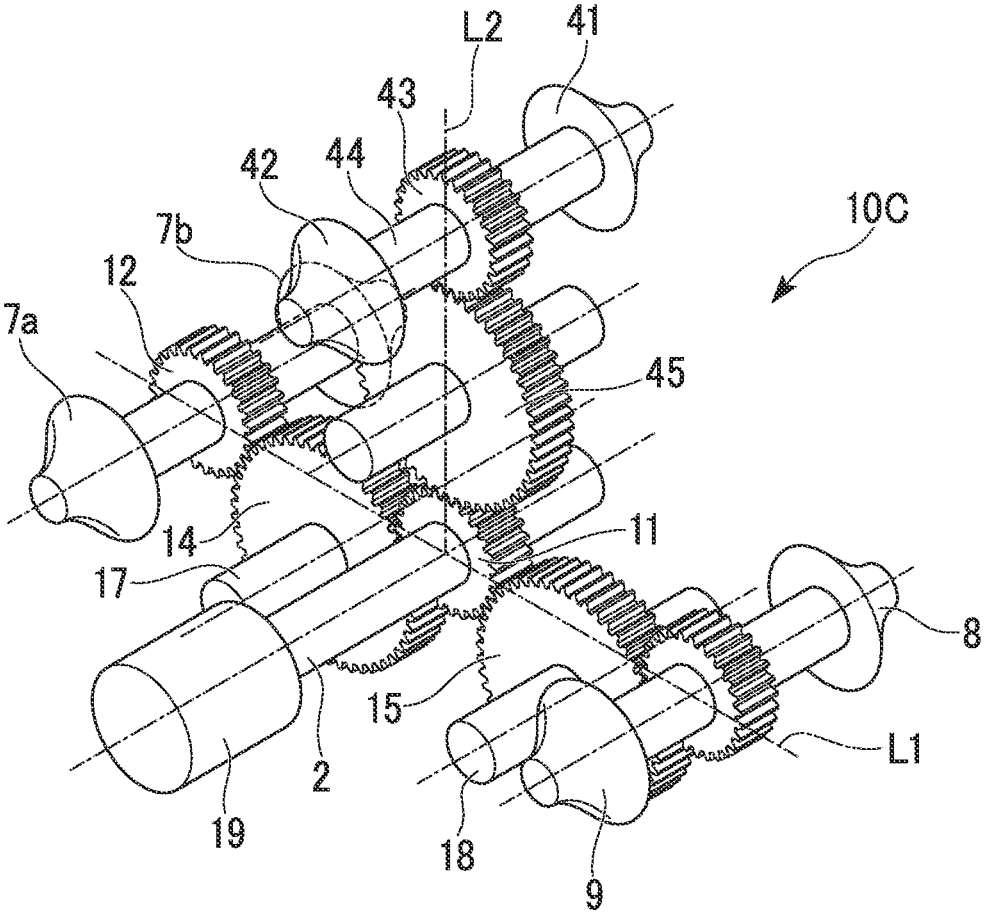
FIG. 4 is a schematic perspective view showing arrangement of gears constituting the speed increasing gear system of the centrifugal compressor related to the second embodiment of the present invention.
Figure 5:
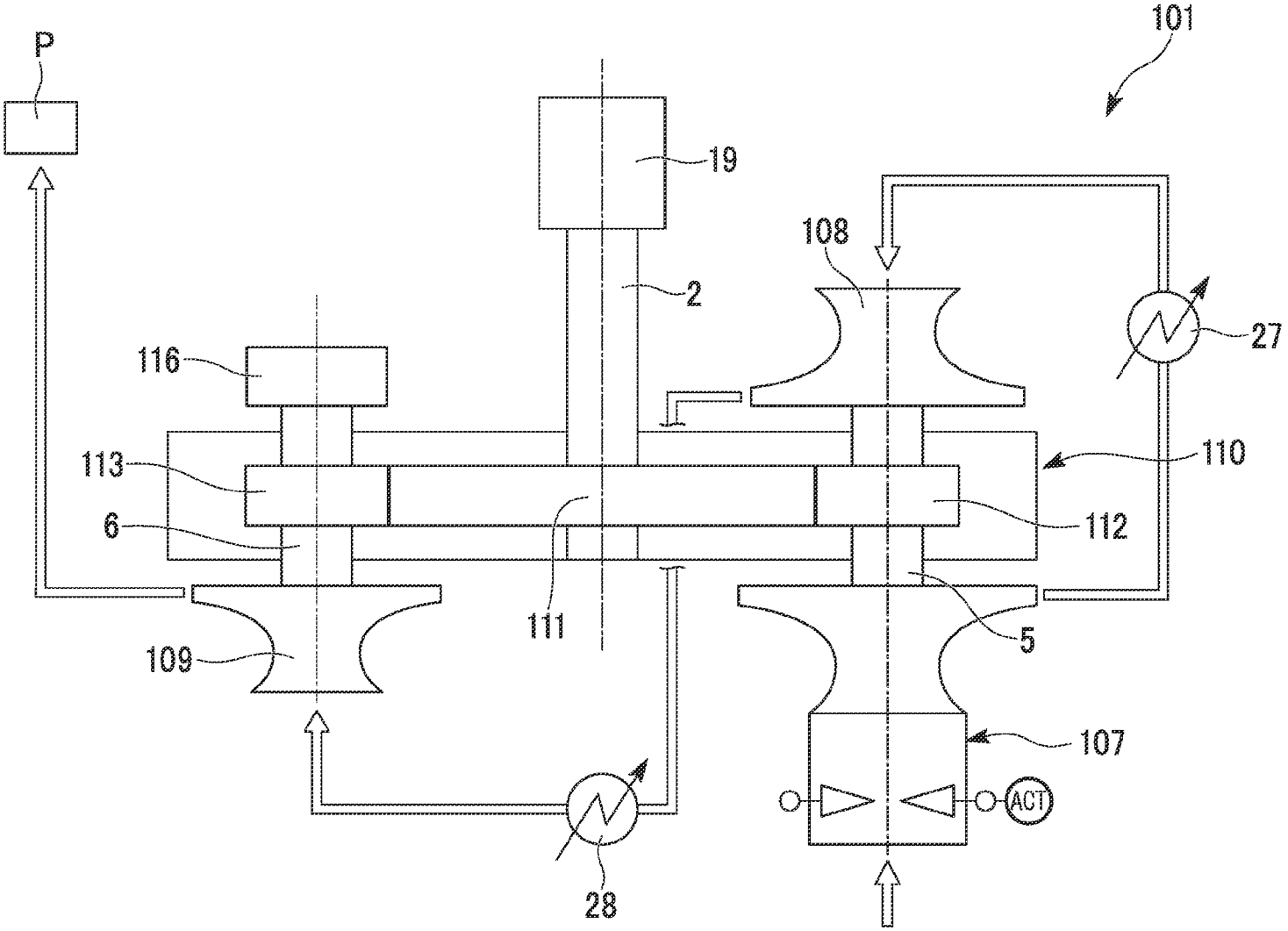
FIG. 5 is a schematic plan view of a conventional centrifugal compressor.

FIG. 4 is a schematic perspective view showing arrangement of gears constituting the speed increasing gear system 10C of the centrifugal compressor 1B related to the second embodiment of the present invention. As shown in FIG. 4, the no. 3 driven pinion gear 43 is provided above the drive gear 11 provided to the drive shaft 2. On each end of the no. 3 driven pinion gear 43, the no. 3 driven pinion shaft 44 is protruded. Also, the no. 3 idle gear 45 is provided between the no. 3 driven pinion gear 43 and the drive gear 11.

On each end of the no. 3 driven pinion shaft 44, each of the fourth stage compressor section 41 and the fifth stage compressor section 42 is provided. The fourth stage compressor section 41 and the fifth stage compressor section 42 are configured in the same manner as the second stage compressor section 8 and the third stage compressor section 9, and they compress the work fluid with impellers.

The fourth stage compressor section 41 is the compressor section provided in the downstream stage of the third stage compressor section 9. The fifth stage compressor section 42 is the compressor section provided in the downstream stage of the fourth stage compressor section 41. The work fluid discharged from the fifth stage compressor section 42 is supplied to a predetermined plant not shown. Similar to the first embodiment, a heat exchanger is provided to each pipe connecting the third stage compressor section 9 and the fourth stage compressor section 42, and the fourth stage compressor section 41 and the fifth stage compressor section 42.

As in the centrifugal compressor 1 related to the first embodiment, the central height levels of the drive gear 11, the no. 1 driven pinion gear 12, and the no. 2 driven pinion gear 13 are set to the substantially the same height level. Also, the centers of the no. 1 idle gear 14 and the no. 2 idle gear 15 are positioned so as to be offset downward relative to the center line L.

In the centrifugal compressor 1B related to the present embodiment, the no. 3 idle gear 45 and the no. 3 driven pinion gear 43 are positioned in a substantially straight line (on the central line L2). That is, the centers of the rotation of the no. 1 and the no. 2 idle gears 14, 15 among the no. 1, no. 2, and no. 3 idle gears 14, 15, 45 are positioned at the lower side with respect to the center of the rotation of the drive gear 11. In addition, the center of the rotation of the remaining intermediate gear among the three intermediate gears is positioned at the upper side with respect to the center of the rotation of the drive gear 11.

Also, the present embodiment is not particularly limited by the above-described arrangement of intermediate gears, as long as the rotation centers of two intermediate gears among the three intermediate gears are positioned at the upper or lower side with respect to the rotation center of the drive gear 11, and the rotation center of the remaining intermediate gear among the three intermediate gear is positioned at the other side of the two intermediate gears with respect to the drive gear 11.

According to the above-described embodiment, compression ratio of the centrifugal compressor can be further increased by having the compression section constituting the centrifugal compressor to be five-staged or more.

Also, as in the centrifugal compressor 1 related to the first embodiment, more load is placed on the bearing supporting the drive shaft 2. Therefore, the status of the drive shaft 2 in operation can be stabilized.

Also, by distributing each of the rotation centers of the no. 1 and no. 2 idle gears 14, 15 and the rotation center of the no. 3 idle gear 45 to each of the upper and lower sides, interference between each of intermediate gears can be prevented.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

For example, the centrifugal compressors are configured to have the intermediate gears provide between the driven gear and the drive gear in the above-described embodiments. However, the intermediate gear is not essential as long as enough distance is kept between the drive shaft and the driven pinion shaft.

Also, the number of stages of the compressor section is not limited to 3 or 5, and it can be appropriately modified in accordance with the needed compression performance.

INDUSTRIAL APPLICABILITY

The capacity of the geared centrifugal compressor can be increased without enlarging impellers. Thus, plants for petrochemistry, natural gas, or air separation can be utilized more effectively.

BRIEF DESCRIPTION OF THE REFERENCE SYMBOLS

1: Centrifugal compressor
2: Drive shaft
3: Driven pinion shaft
4: Compressor section
5: No. 1 driven pinion shaft
6: No. 2 driven pinion shaft
7: First stage compressor section
8: Second stage compressor section
9: Third stage compressor section
10: Gearbox
11: Drive gear
12: No. 1 driven pinion gear
13: No. 2 driven pinion gear
14: No. 1 idle gear
15: No. 2 idle gear
17: No. 1 idle shaft
18: No. 2 idle shaft
22*a*, 22*b* (22): First stage compressor
24: Inlet guide vane
27: First stage heat exchanger (heat exchanger)
27*a*: Inlet nozzle (inlet)
27*b*: Outlet nozzle (outlet)
41: Fourth stage compressor section
42: Fifth stage compressor section
43: No. 3 driven pinion gear
44: No. 3 driven pinion shaft
45: No. 3 idle gear
50: Control system (control unit)
51: First pressure sensor
52: Flowmeter
53: Second pressure sensor

The invention claimed is:

1. A centrifugal compressor comprising:

a drive gear;

a drive shaft protruding from one side of the drive gear in a central axis direction of the drive gear;

a no. 1 driven pinion gear configured for rotation of the drive gear to be transmitted thereto;

a no. 1 driven pinion shaft protruding from both sides of the no. 1 driven pinion gear in a central axis direction of the no. 1 driven pinion gear;

a couple of first stage compressor sections, each of which is provided in each end of the no. 1 driven pinion shaft and is configured to compress fluid by rotation of the no. 1 driven pinion shaft;

a no. 1 idle gear provided between the no. 1 driven pinion gear and the drive gear;

a no. 2 driven pinion gear configured for rotation of the drive gear to be transmitted thereto;

a no. 2 driven pinion shaft protruding from the no. 2 driven pinion gear in a central axis direction of the no. 2 driven pinion gear;

a second stage compressor section provided to the no. 2 driven pinion shaft; and a no. 2 idle gear provided between the no. 2 driven pinion gear and the drive gear, wherein rotation axes of the drive shaft, the no. 1 driven pinion shaft, and the no. 2 driven pinion shaft are positioned at the same level in height, a rotation axis of the no. 1 idle gear is positioned upward or downward with respect to a plane defined by the rotation axes of the drive shaft, the no. 1 driven pinion shaft, and the no. 2 driven pinion shaft, and a rotation axis of the no. 2 idle gear is positioned at the same side of the rotation axis of the no. 1 idle gear with respect to the plane defined by the rotation axes of the drive shaft, the no. 1 driven pinion shaft, and the no. 2 driven pinion shaft.

2. The centrifugal compressor according to claim 1, further comprising:

a third stage compressor section provided to the no. 2 driven pinion shaft in an opposite side to the second stage compressor section in the central axis direction of the no. 2 driven pinion gear;

a no. 3 driven pinion gear configured for rotation of the drive gear to be transmitted thereto;

a no. 3 driven pinion shaft protruding from the no. 3 driven pinion gear in a central axis direction of the no. 3 driven pinion gear;

a fourth stage compressor section provided to the no. 3 driven pinion shaft; and a no. 3 idle gear provided between the no. 3 driven pinion gear and the drive gear, wherein a rotation axis of the no. 3 idle gear is positioned at on an opposite side of the rotation axes of the no. 1 idle gear and the no . 2 idle gear with respect to the plane defined by the rotation axes of the drive shaft, the no. 1 driven pinion shaft, and the no. 2 driven pinion shaft.

3. The centrifugal compressor according to claim 2, further comprising a heat exchanger provided to a pipe connecting the pair of the first stage compressor sections and the second stage compressor section, the heat exchanger exchanging heat of the fluid discharged from the pair of the first stage compressor sections, wherein the heat exchanger comprises: two inlets, each of which is connected to each of the pair of the first stage compressor sections; and an outlet connected to the second stage compressor section.

4. The centrifugal compressor according to claim 3, further comprising:

an inlet guide vane that is provided to each of the pair of the first stage compressor sections at an upstream side thereof and configured to control an amount of the fluid introduced to the pair of the first stage compressor sections;

a first pressure sensor and a flowmeter provided to each of the pair of the first stage compressor sections at an upstream side thereof;

a second pressure sensor provided to each of the pair of the first stage compressor sections at a downstream side thereof; and a control unit configured to control the inlet guide vane based on measurements detected by the first pressure sensor, the flow meter, and the second pressure sensor.

5. The centrifugal compressor according to claim 2, further comprising:

an inlet guide vane that is provided to each of the pair of the first stage compressor sections at an upstream side thereof and configured to control an amount of the fluid introduced to the pair of the first stage compressor sections;

a first pressure sensor and a flowmeter provided to each of the pair of the first stage compressor sections at an upstream side thereof;

a second pressure sensor provided to each of the pair of the first stage compressor sections at a downstream side thereof; and a control unit configured to control the inlet guide vane based on measurements detected by the first pressure sensor, the flow meter, and the second pressure sensor.

6. The centrifugal compressor according to claim 1, further comprising a heat exchanger provided to a pipe connecting the pair of the first stage compressor sections and the second stage compressor section, the heat exchanger exchanging heat of the fluid discharged from the pair of the first stage compressor sections, wherein the heat exchanger comprises: two inlets, each of which is connected to each of the pair of the first stage compressor sections; and an outlet connected to the second stage compressor section.

7. The centrifugal compressor according to claim 6, further comprising:

an inlet guide vane that is provided to each of the pair of the first stage compressor sections at an upstream side thereof and configured to control an amount of the fluid introduced to the pair of the first stage compressor sections;

a first pressure sensor and a flowmeter provided to each of the pair of the first stage compressor sections at an upstream side thereof;

a second pressure sensor provided to each of the pair of the first stage compressor sections at a downstream side thereof; and a control unit configured to control the inlet guide vane based on measurements detected by the first pressure sensor, the flow meter, and the second pressure sensor.

8. The centrifugal compressor according to claim 1, further comprising:

an inlet guide vane that is provided to each of the pair of the first stage compressor sections at an upstream side thereof and configured to control an amount of the fluid introduced to the pair of the first stage compressor sections;

a first pressure sensor and a flowmeter provided to each of the pair of the first stage compressor sections at an upstream side thereof;

a second pressure sensor provided to each of the pair of the first stage compressor sections at a downstream side thereof; and a control unit configured to control the inlet guide vane based on measurements detected by the first pressure sensor, the flow meter, and the second pressure sensor.

* * * * *